US007461994B2

(12) United States Patent
Whaley

(10) Patent No.: US 7,461,994 B2
(45) Date of Patent: Dec. 9, 2008

(54) TWIST LOCK RING BINDER

(75) Inventor: Paul Whaley, Herculaneum, MO (US)

(73) Assignee: U.S. Ring Binder, L.P., St. Louis, MO (US)

( * ) Notice: Subject to any disclaimer, the term of this patent is extended or adjusted under 35 U.S.C. 154(b) by 312 days.

(21) Appl. No.: 11/241,445

(22) Filed: Sep. 30, 2005

(65) Prior Publication Data

US 2007/0086834 A1 Apr. 19, 2007

(51) Int. Cl.
*B42F 3/02* (2006.01)
*B42F 13/02* (2006.01)

(52) U.S. Cl. ..... 402/20; 402/19

(58) Field of Classification Search ..... 402/46, 402/55, 56, 19, 20, 36, 70, 73, 80 R
See application file for complete search history.

(56) References Cited

U.S. PATENT DOCUMENTS 5,660,490 A * 8/1997 Warrington ..... 402/36
5,816,729 A 10/1998 Whaley
6,036,394 A 3/2000 Cheng
6,116,804 A 9/2000 Mehta
6,328,497 B1 * 12/2001 To ..... 402/26
6,764,100 B1 7/2004 Miro
2005/0163557 A1 * 7/2005 England ..... 402/73
2006/0153628 A1 * 7/2006 Tanaka et al. ..... 402/35

* cited by examiner

*Primary Examiner*—Dana Ross
*Assistant Examiner*—Pradeep C Battula
(74) *Attorney, Agent, or Firm*—Polster, Lieder, Woodruff & Lucchesi, L.C.

(57) ABSTRACT

An improved "twist-lok" binder ring metal 10 includes binder rings (12-16) comprised of pairs of binder ring halves having an end attached to leaves (18, 20). Each leaf has swedges (18*a*, 18*b*, 20*a*, 20*b*) are spaced along the length of the metal. A cover (22) fitting over the leaves has spaced openings (24) through which ring halves extend. The cover and leaves only have a point contact with each other, and the leaves extend away from the cover at a relatively shallow angle.

The binder is opened by someone exerting finger pressure on one of the rings and twisting the ring halves apart. Because of the shallow angle of the leaves with respect to each other, the leaves do not readily rotate to a ring open position if the binder is dropped or bumped. The result is a ring metal readily opened by use of finger pressure on a binder ring, but which will not open if the binder is bumped or dropped.

17 Claims, 2 Drawing Sheets

TWIST LOCK RING BINDER

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

In U.S. Pat. No. 5,660,490, there is described a binder ring metal commonly referred to as a "twist-lok" metal. An advantage of this type metal is that it is relatively easy for a user to open by applying finger pressure to respective halves of a binder ring, typically near the respective ends of the ring halves where they join together to close the metal. The user then moves his or her fingers in a rotary or twisting manner to separate the ends of the halves. The opposite ends of the ring halves are connected to separate leaves which extend side-by-side beneath a cover portion of the metal. The leaves have swedges which are angled with respect to the leaves and the twisting movement of the upper portion of the ring halves causes the leaves to sufficiently flex so that an over center toggling action occurs and the binder rings remain open after the finger pressure is released.

A problem with previous twist-lok metals has been that they are prone to open when a binder in which they are installed is accidentally dropped. If a binder falls off a table, or is bumped out of a person's hands while they are carrying the binder, it often occurs that one or more of the binder rings spring apart, opening the binder. The person then must retrieve the binder and re-close the rings, hopefully without having lost any pages out of the binder. The present invention is directed to an improved twist-lok ring metal which is still easy to open, but which now does not inadvertently open when dropped, bumped, or otherwise subjected to a force.

BRIEF SUMMARY OF THE INVENTION

The present invention is related to an improved "twist-lok" binder ring metal. The metal includes a plurality of binder rings each comprised of a pair of binder ring halves which interconnect to close a ring. Opposite ends of each half are attached to separate leaves which extend the length of the metal parallel to each other. Each leaf has a series of spaced swedges and the swedges of the respective leaves are located side-by-side. A shield or cover fits over the leaves and has a spaced openings through which the ring halves extend. The outer margin of the cover, on each side of the cover, is bent over the outer edges of the respective leaves to secure the leaves beneath the cover. There is only a point contact between the leaves and cover, and the leaves extend from the underside of the cover at a relatively shallow angle to each other.

A user opens the binder by exerting finger pressure on one of the rings. The openings in the shield through which the ring halves extend are wider than the diameter of a ring half to make it easier to separate ring halves and open the binder. However, the leaves and their associated swedges are at a shallow angle with respect to each other, the leaves do not readily rotate to a ring open position if the binder is dropped or bumped. The result is a ring metal readily opened by the exertion of finger pressure on a binder ring, but not when the binder is bumped or dropped.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 4:
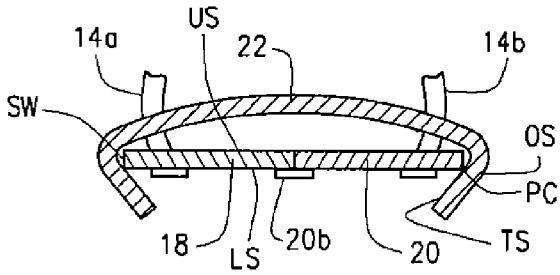
FIG. 4 is a sectional view similar to FIG. 3 for a ring metal of the present invention.

Referring to the drawings, a binder ring metal 10 of the present invention is for installation in a binder (not shown) for holding hole punched sheets of paper or the like. Ring metal 10 is a "twist-lok" metal having a plurality of binder rings indicated generally 12, 14, and 16. The metal may have more, or fewer, rings without departing from the scope of the invention. Each ring is comprised of two ring halves 12*a*-12*b*, 14*a*-14*b*, and 16*a*-16*b* respectively. One end of each ring half is attached to a plate or leaf 18, 20. The leaves 18, 20 are rectangular plates which extend parallel to each other in a side-by-side relationship substantially the length of the ring metal. As shown in FIG. 4, each leaf 18, 20 has an upper surface US, a lower surface LS and a sidewall SW connecting the upper surface US and the lower surface LS. A cover or shield 22 fits over the plates and the cover has spaced openings 24 extending along each side of its upper edge for the ring halves to extend through the cover. The cover 22 further has an outer surface OS and an inner surface IS. A trigger 26 is connected to the leaves, at each end of the metal, to open the binder rings when pressure is applied to the trigger. Movement of the trigger rocks the leaves away from each other, spreading the outer ends of the ring halves apart, so to open the binder.

Figure 1:
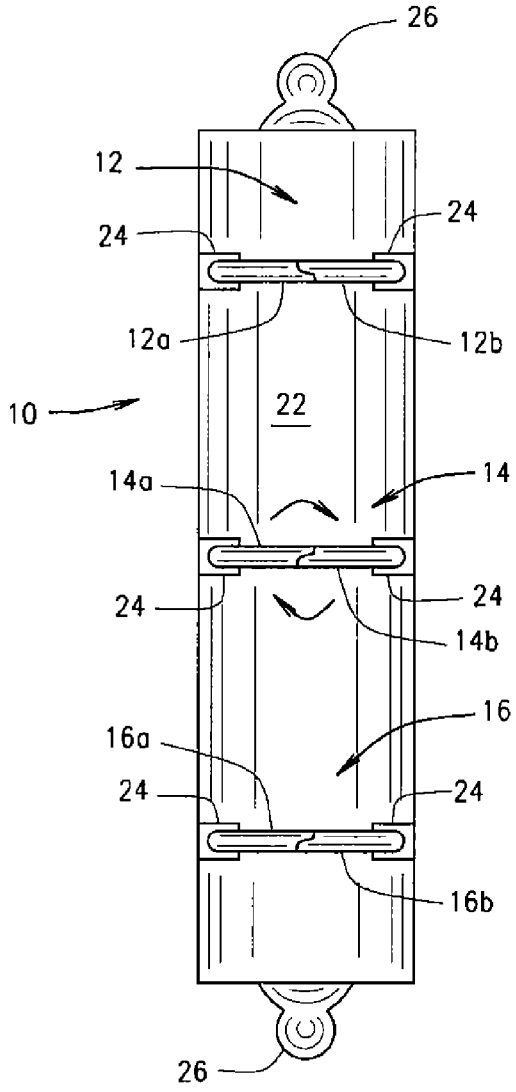
FIG. 1 is a plan view of the top of a ring metal of the present invention.

As shown in by the arrows in FIG. 1, the binder rings can also be opened by someone putting their fingers on the sides of the respective ring halves, and by twisting the halves in the direction of the arrows. This action not only separates the outer end of the ring halves, but the force applied is transmitted through the ring halves to the leaves to which the halves are attached causing the leaves to flex away from each other to their binder open position. As previously noted, previous twist-lok type metals are prone to opening when the binder on which they are installed is dropped or bumped off a table, or knocked out of a person's hand.

The present invention is directed at first, making it easier for a person to open a "twist-lok" metal. But second, and at the same time, the present invention substantially prevents the binder rings from being inadvertently or accidentally opened for one of the above noted reasons.

Figure 3:
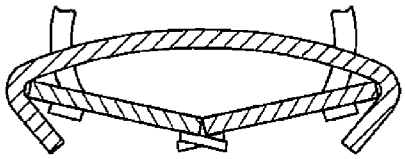
FIG. 3 PRIOR ART
FIG. 3 is a sectional view of a prior art ring metal illustrating attachment of the leaves to the cover.

To do this, binder ring metal 10 of the present invention has a number of features which are significantly different from conventional prior art "twist-lok" metals of the type shown in FIG. 3. First, with respect to FIG. 1, the openings 24 on the top of cover 10 and through which the binder ring halves extend, are wider than the corresponding openings in prior art metals. What this does is that when a person applies finger pressure to the halves of a binder ring, affecting a twisting motion, flexing of the rings does not bring them into contact with cover 22. In previous "twist-lok" ring metals, the width of these openings was only slightly larger than the diameter of the ring half. Accordingly, when the ring half was twisted, the distortion or bending of the ring half which resulted would bring the ring half into contact with the side of the opening. This resulted in a bind between the ring half and the opening which, while not great, still required a greater force to be exerted on the ring half than is now required with metal 10.

Figure 2:
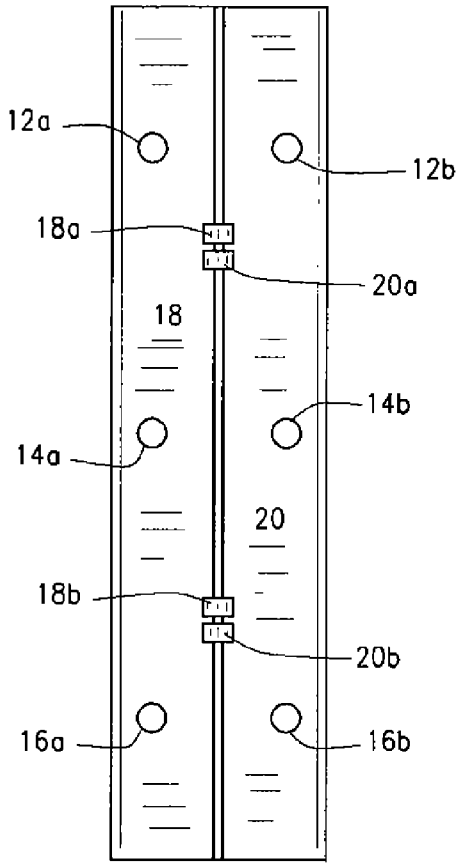
FIG. 2 is a plan view of the underside of the metal without the cover.

Next, in previous "twist-lok" metal constructions, when the outer edges of cover 22 were bent over and around the outer edges of leaves 16, 18, there was a substantial arc of contact between the outer edge of the leaves, and the underside of the cover. This is as shown in FIG. 3. Further, the leaves extended inwardly from the sides of the cover at a rather steep angle, again as shown in FIG. 3. As shown in FIG. 2, each leaf 18, 20 has a series of spaced swedges formed on, or connected to the outer surface of the leaf. Two such swedges 18*a*, 18*b* and 20*a*, 20*b* are shown in FIG. 2. As shown in this Fig., the swedges of the respective leaves are located side-by-side along the length of ring metal 10.

As shown in FIG. 4, there are two substantial changes in the design and construction of ring metal 10 over the prior art constructions. First, the inner surface IS of cover 22 does not have an extended length of contact with the outer edge of leaf 18, 20. Rather, there is substantially only a point contact PC between the cover and leaf at the inner surface IS of the cover 22 and the lower surface LS of the leaves 18, 20. Second, the angle at which the leaves extended inwardly from the sides of the cover is at a much shallower angle than before. This means that the leaves have a much flatter aspect with respect to each other, as shown in FIG. 4, than as shown in FIG. 3. This further means that the swedges 18*a*, 18*b* and their adjacent swedges 20*a*, 20*b* are at a much shallower angle with respect to each other than before. The result is that if the binder in which metal 10 is installed is dropped or bumped, there is less hinging of the leafs 18, 20 with respect to each other and the plates are less apt to toggle over center, opening the binder rings 12-16. Accordingly, binder metal 10 will remain closed and no spillage of the binder contents will occur.

The binder is therefore readily opened by someone exerting finger pressure on one of the rings and twisting the ring halves apart. However, because of the shallow angle of the leaves with respect to each other, the leaves do not readily rotate to a ring open position if the binder is dropped or bumped. The result is a ring metal readily opened by use of finger pressure on a binder ring, but which will not open if the binder is bumped or dropped.

Figure 5:
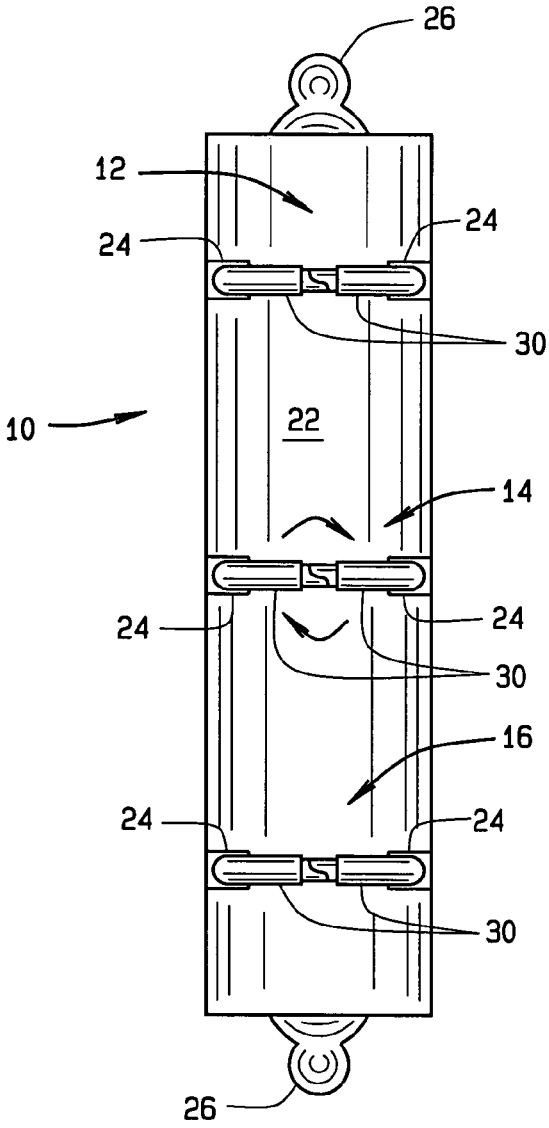
FIG. 5 is a view similar to FIG. 1 illustrating a second embodiment of the invention; and, FIG. 6 is a sectional view similar to FIG. 3 illustrating a binder ring having a sleeve fitted over each ring half.
Figure 6:
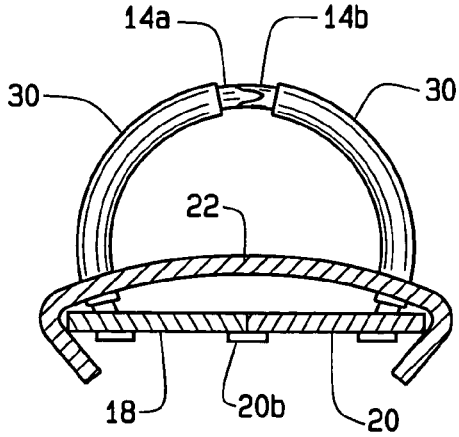

Referring to FIGS. 5 and 6, a second embodiment of the invention includes sleeves or covers 30 which are fitted over each binder ring half such as the ring halves 14*a*, 14*b* shown in FIG. 6. The sleeves 30 are fitted over the outer ends of each ring half and extend substantially the length of each half, and preferably to where the ring half disappears below the top of cover 22 through the openings 24. The covers can be put on all of the binder ring halves, as shown in FIG. 5, or they can be put on only one or two of the rings. The material from which the sleeves are made enable the sleeves to slide easily over the curved ring half surface, with the outer surface of the sleeve being sufficiently smooth that when in place, the sleeves do not interfere with opening or closing of the binder rings as described above, or with placing papers in the binder, removing them from the binder, or flipping papers from one side of the binder to the other. The sleeves are either permanently fitted in place over each ring half 14*a*, 14*b*, or the sleeves can be slidably removable from the ring halves.

The sleeves can be installed over the ring halves during manufacture of ring metal 10, or they can be put on any time thereafter. The sleeves may be plain, or may be available in a variety of colors. For example, the sleeves come in packages with a variety of colors so students could slide ones representing their school colors over the ring halves in their binders. Or, if a business or organization uses a particular color, or associates a particular color (brown or red, for example) with its business, the binder ring halves would be covered with sleeves of that color.

In view of the above, it will be seen that the several objects and advantages of the present invention have been achieved and other advantageous results have been obtained.

Having thus described the invention, what is claimed and desired to be secured by Letters Patent is:

1. A "twist lok" binder ring metal comprising:

at least one binder ring comprised of a pair of binder ring halves with one end of each ring half being attached to a separate leaf and the other end of the ring halves interfitting with each other when the binder ring is closed;

a cover fitting over the leaves and having opposed openings therein through which the ring halves extend, the cover further having an outer surface and an inner surface, and, when the binder ring is closed, the leafs having only a single point of contact with each other and with the inner surface of the cover for the leafs to extend beneath the cover in a substantially flat orientation whereby when a user exerts a twisting force on the respective ring halves to separate the ring halves and open the binder the force exerted on the ring halves causes the leafs to flex and move apart from each other, but the closing force otherwise exerted by the leafs on keeping the binder ring closed for the binder ring not to open when a binder in which the metal is installed is dropped or bumped; and a sleeve fitting over each half of the binder ring.

2. The binder ring metal of claim 1 wherein each leaf has at least one swedge with the swedges on the respective leaves being adjacent each other.

3. The binder ring metal of claim 1 further including a plurality of binder rings spaced along the length of the metal, each binder ring being comprised of a pair of binder ring halves with one end of each ring half being attached to a separate leaf and the other end of the ring halves interfitting with each other when the binder ring is closed, the cover having opposed openings spaced along the length thereof through which the ring halves extend.

4. The binder ring metal of claim 3 in which the openings through which the binder ring halves extend are substantially larger than a diameter of the ring halves so that when the twisting force is exerted against the halves of a binder ring, a resulting flexing of the rings does not bring them into contact with the cover and they do not bind against the cover.

5. The binder ring metal of claim 1 in which the leaves extend beneath the cover at an angle sufficiently shallow that a force exerted on the metal, when the binder is dropped or bumped, does not cause the leaves to toggle between a binder ring closed position and a binder ring open position.

6. The binder ring metal of claim 1 in which the sleeves are slidably receivable on a binder ring half with the outer surface of the sleeve being sufficiently smooth that, when in place, the sleeves do not interfere with opening or closing of the binder rings, or with placing papers into or removing them from a binder, or with flipping papers from one side of the binder to the other.

7. The binder ring metal of claim 1 in which the sleeve is fitted permanently in place on a binder ring half.

8. The binder ring metal of claim 1 in which the sleeve is removably installed on a binder ring half.

9. A binder ring metal comprising:

at least one binder ring comprised of a pair of binder ring halves with one end of each ring half being attached to a separate leaf and the other end of the ring halves interfitting with each other when the binder ring is closed, each leaf having an upper surface, a lower surface and a sidewall connecting the upper surface and the lower surface;

a cover filling over the leaves and having opposed openings through which the ring halves extend, the cover further having an outer surface and an inner surface; and, a sleeve filling over each half of a the binder ring, wherein the cover and each leaf having only a single point of contact with each other at the inner surface of the cover and the bottom surface of the leaves, the leaves extending away from the single point of contact at a relatively shallow angle whereby when a user exerts a twisting force on the respective ring halves the ring halves separate to open the binder, but the binder ring not opening when a binder in which the metal is installed is dropped or bumped.

10. The binder ring metal of claim 9 in which the sleeves are slidably receivable on a binder ring half with the outer surface of the sleeve being sufficiently smooth that, when in place, the sleeves do not interfere with opening or closing of the binder rings, or with placing papers into or removing them from a binder, or with flipping papers from one side of the binder to the other.

11. The binder ring metal of claim 10 in which the sleeve is fitted permanently in place on a binder ring half.

12. The binder ring metal of claim 11 in which the sleeve is removably installed on a binder ring half.

13. The binder ring metal of claim 9 wherein each leaf has at least one swedge with the swedges on the respective leaves being adjacent each other.

14. The binder ring metal of claim 9 further including a plurality of binder rings spaced along the length of the metal, each binder ring being comprised of a pair of binder ring halves with one end of each ring half being attached to a separate leaf and the other end of the ring halves interfitting with each other when the binder ring is closed, the cover having opposed openings spaced along the length thereof through which the ring halves extend.

15. The binder ring metal of claim 14 in which the openings through which the binder ring halves extend are substantially larger than a diameter of the ring halves so that when the twisting force is exerted against the halves of a binder ring, a resulting flexing of the rings does not bring them into contact with the cover and they do not bind against the cover.

16. A binder ring metal comprising:

at least one binder ring comprised of a pair of binder ring halves with one end of each ring half being attached to a separate leaf and the other end of the ring halves interfitting with each other when the binder ring is closed, each leaf having an upper surface, a lower surface and a sidewall connecting the upper surface and the lower surface;

a cover filling over the leaves and having opposed openings through which the ring halves extend, the cover further having an outer surface and an inner surface;

a sleeve fitting over each half of the binder ring, wherein the cover and each leaf having only a single point of contact with each other at the inner surface of the cover and the bottom surface of the leaves, the leaves extending away from the cover at a relatively shallow angle whereby when a user exerts a twisting force on the respective ring halves the ring halves separate to open the binder, but the binder ring not opening when a binder in which the metal is installed is dropped or bumped; and wherein the leaves extend beneath the cover at the angle such that a force exerted on the metal, when the binder is dropped or bumped, does not cause the leaves to toggle between a binder ring closed position and a binder ring open position.

17. A binder ring metal comprising:

at least one binder ring comprised of a pair of binder ring halves with one end of each ring half being attached to a separate leaf and the other end of the ring halves interfitting with each other when the binder ring is closed, each leaf having an upper surface, a lower surface and a sidewall connecting the upper surface and the lower surface;

a cover fitting over the leaves and having opposed openings through which the ring halves extend, the cover further having an outer surface and an inner surface the cover and each leaf having only a single point of contact with each other at the inner surface of the cover and the bottom surface of the leaves, and the leaves extending away from the cover at a relatively shallow angle whereby when a user exerts a twisting force on the respective ring halves the ring halves separate to open the binder, but the binder ring not opening when a binder in which the metal is installed is dropped or bumped;

a sleeve fitting over each half of the binder ring; and wherein the leaves are not biased towards an open or closed position by a biasing member.

* * * * *